US007062829B2

(12) United States Patent
Perez

(10) Patent No.: US 7,062,829 B2
(45) Date of Patent: Jun. 20, 2006

(54) GOLF CLUB FIXTURE

(75) Inventor: Eddie G. Perez, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 160 days.

(21) Appl. No.: 10/695,755

(22) Filed: Oct. 30, 2003

(65) Prior Publication Data

US 2005/0093218 A1 May 5, 2005

(51) Int. Cl.
*B25B 1/20* (2006.01)

(52) U.S. Cl. ..... 29/281.5

(58) Field of Classification Search ..... 269/268, 269/270, 269, 285, 286, 126, 127, 128, 909; 29/281.1, 281.5

See application file for complete search history.

(56) References Cited

U.S. PATENT DOCUMENTS

| | | | | |
|---|---|---|---|---|
| 124,108 | A * | 2/1872 | Anderson | 269/268 |
| 3,439,429 | A | 4/1969 | Sundstrom | |
| 3,631,602 | A | 1/1972 | Noel | |
| 3,822,477 | A | 7/1974 | Collins | |
| 4,094,072 | A | 6/1978 | Erb | |
| 4,245,392 | A | 1/1981 | Heller | |
| 4,620,431 | A | 11/1986 | Muldoon | |
| 4,640,017 | A | 2/1987 | Cukon | |
| D306,979 | S | 4/1990 | Cukon | |
| D316,660 | S | 5/1991 | Cukon | |
| D324,897 | S | 3/1992 | Colucci | |
| D340,653 | S | 10/1993 | Cukon | |
| 5,421,098 | A | 6/1995 | Muldoon | |
| D376,112 | S | 12/1996 | Cukon | |
| 5,884,409 | A | 3/1999 | Muldoon | |
| 6,250,168 | B1 | 6/2001 | D'Aguanno | |
| 6,363,620 | B1 | 4/2002 | Goodjohn | |
| 2002/0123383 | A1 | 9/2002 | Cameron | |

OTHER PUBLICATIONS

Material Safety Data Sheet for RP 132 Resin.
Material Saftey Data Sheet for RP 3262 Resin.
Material Safety Data Sheet for RP 3269 Resin.
Golf Equipment Universal Catalogue 2000, p. 577.
Mitchell Golf Equipment Company, 2001 Catalog, Golf Club Assembly, Fitting & Repair Equipment, pp. 12-17.

* cited by examiner

*Primary Examiner*—Robert C. Watson
(74) *Attorney, Agent, or Firm*—Bingham McCutchen LLP

(57) ABSTRACT

A club fixture device for facilitating customization of a golf club head is disclosed. The club fixture device includes a housing, an insert, and a locking mechanism. The housing preferably contains two parts connected by a hinge. The insert is selected based upon the golf club to be customized. The insert is preferably divided into two parts to surround the golf club head. Each insert part is removably coupled to one of the housing parts. A golf club head is placed within the cavity, the housing is closed, and the locking mechanism retains the device in a closed position.

32 Claims, 10 Drawing Sheets

GOLF CLUB FIXTURE

BACKGROUND OF THE INVENTION

1. Field of the Invention

The present invention generally relates to golf clubs. In particular, the present invention relates to a fixture for manipulating the loft and lie angles of a golf club.

2. Description of the Related Art

Technological innovations and a greater understanding of golf swing dynamics have allowed golf club manufacturers to provide a significant level of customization to match golf clubs to a particular golfer according to, for example, the golfer's unique swing. Various golf club design parameters may be customized, such as an adjustment of the angular relationship of the golf club head with respect to the shaft and the ground. Such customization is useful, for example, because when two golfers with dissimilar heights address a golf ball using the same club, the angle formed by the shaft of the club with respect to the ground will invariably be different for each golfer. Similarly, depending on the golfer's stance and playing characteristics, the angle formed by the club face will also vary among golfers. Thus, to improve a golfer's performance with a particular club, these are two parameters regarding the relative position of the golf club head to the shaft that are often customized to fit the golfer.

FIG. 1 shows a known golf club 100. Golf club 100 includes a shaft S, a hosel Hs, and head H. Head H includes a heel area He, a toe area T, a face F, a rear area R, a crown area C, and sole area (not shown) opposite crown C. The lie angle is the angle formed between a center line extending through the shaft S with a line parallel to the sole S. Proper lie angle is important to ensure that the golf club makes a square contact with the ball during the execution of a swing. For example, if the lie is less than ideal, the sole of the golf club will most likely be upwardly angled when the club head impacts the ball. As a result, the face of the club head will be aimed to the left of the medial line of the fairway for a right-handed club, resulting in a left-of-center flight path. Conversely, if the lie is greater than ideal, the club's sole will likely be downwardly angled at the point of impact for a right-handed club and the opposite effect will be obtained.

The loft angle is the angle between the face F and the vertical plane. The greater the loft angle, the greater the loft of the ball after being struck by the golf club. Proper loft angle is important to ensure the desired distance is achieved. For example, if the loft angle is too great, the ball flight will most likely be too high. As a result, energy will be wasted traveling upward instead of down the fairway. Conversely, if the loft angle is too small, the ball will impact the ground too early, resulting in decreased distance. The measurements of the loft angle, however, may not be indicative of the performance of the club when used by a particular golfer because the physiological and swing characteristics of the golfer can effect the resultant ball flight. Accordingly, in providing a more customized set of clubs for a particular golfer, the loft angle is often personalized to meet the particular physical traits and abilities of the individual golfer.

Moreover, as golfers rely on a golf club having a particular loft and lie angle to perform in a particular fashion, any variation based on use or manufacturing tolerance may be quite undesirable, especially for golfers playing at the professional level. Thus, minor adjustments to the loft and lie are often made to the golf clubs used by professional golfers. Such adjustments are typically required at tournaments, on tour, or at various locations remote from manufacturers.

Accordingly, there is a need for a golf club adjustment device that is compact and transportable, while being easy to use.

In addition, due to the mass production of golf clubs, fine tuning of each golf club by adjusting the loft and/or lie of the club is often desirable before the clubs are ready for shipment. Thus, manufacturers often make final adjusts to the loft and lie angles after assembly of the club. Such an operation is highly labor intensive and there is a need for a device that permits adjustments to be made quickly and simply.

SUMMARY OF THE INVENTION

A club fixture device for facilitating customization of a golf club head is disclosed. The device includes a housing, an insert, and a locking mechanism. The insert and the locking mechanism are coupled to the housing. The insert contains a cavity configured to at least partially contact the golf club head therein. Preferably, the cavity is at least partially contoured to the golf club head, and more preferably the cavity substantially envelopes the golf club head. The insert is preferably formed at least in part of resin. Resin inserts can safely grip and retain a golf club head without scratching or otherwise damaging the club.

The housing preferably includes a lower housing part and an upper housing part hingedly coupled to the lower housing part. The insert preferably includes a lower insert part coupled to the lower housing part and an upper insert part coupled to the upper housing part. The insert parts are preferably removably coupled to the respective housing parts, facilitating insert replacement and interchangeability. Each of the insert parts preferably contains a cavity part, the cavity parts being configured to matingly form the cavity. At least one of the lower insert part and the upper insert part defines a hole configured to allow a shaft coupled to the golf club head to pass therethrough.

The locking mechanism preferably includes a cross bar, a locking bar, and a stator bar. The locking bar is selectively engageable with the cross bar to retain the golf club head within the housing. The stator bar is coupled to the housing at one end and hingedly coupled to the cross bar at an opposite end. The locking bar is hingedly coupled to the housing, either directly or through the stator bar. The cross bar is moveable between an open position, in which the housing parts are relatively moveable, and a closed position, in which the housing parts are relatively fixed. In a preferred embodiment, the cross bar includes a notch and the locking bar is configured to fit, at least in part, within the notch. The locking bar includes a lock, and the lock is selectively engageable to retain the cross bar in the closed position or to release the cross bar. In a preferred embodiment, the lock is threadably engageable.

The club fixture device is portable, and may thus be used in a variety of locations. The device may further include a base member for securing the housing member as desired, such as to a work station or vise. The base member may be an integral part of the housing.

Multiple distinct inserts may be interchanged and used with the club fixture device. Each insert may be tailored to a specific golf club. Thus, the club fixture device may be used with each of a group of distinct golf clubs and easily achieve a tight grip on each of the distinct clubs.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
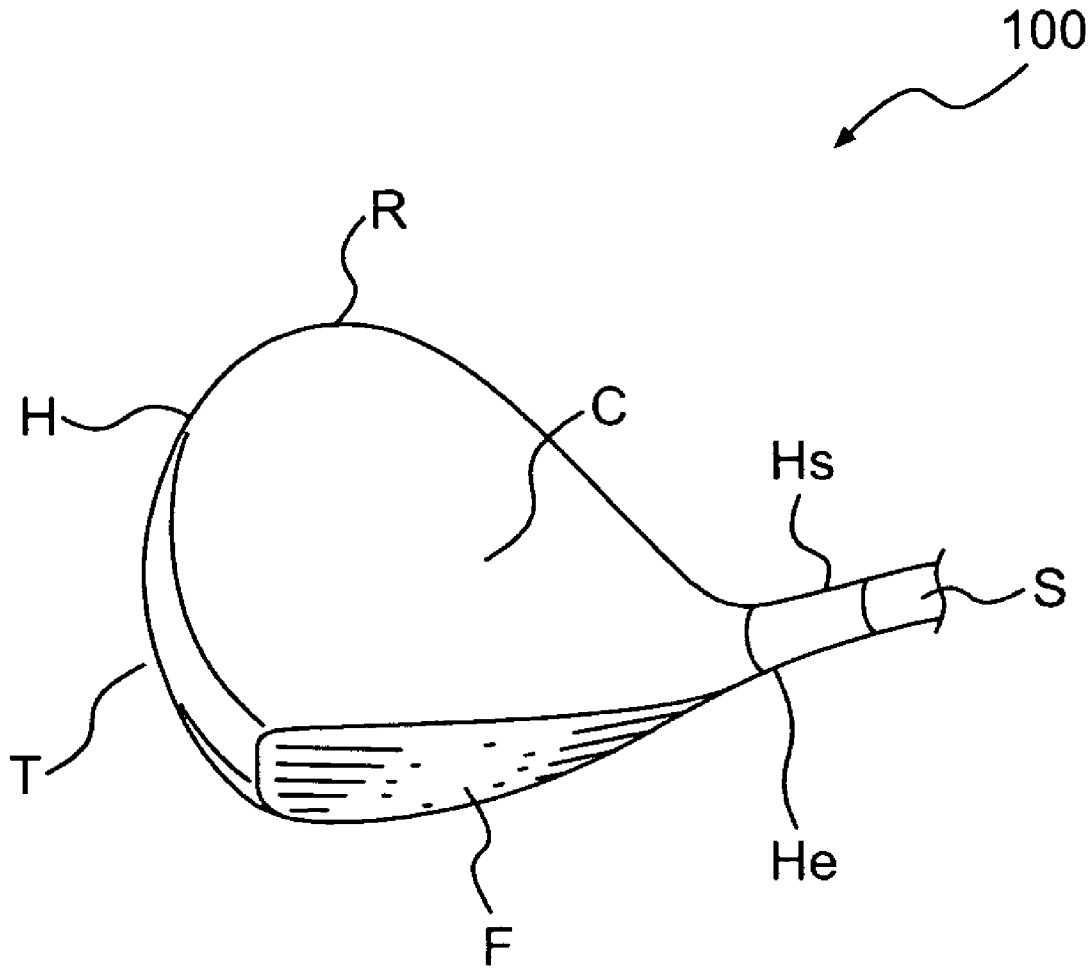
FIG. 1 PRIOR ART
FIG. 1 shows a known golf club.
Figure 2:
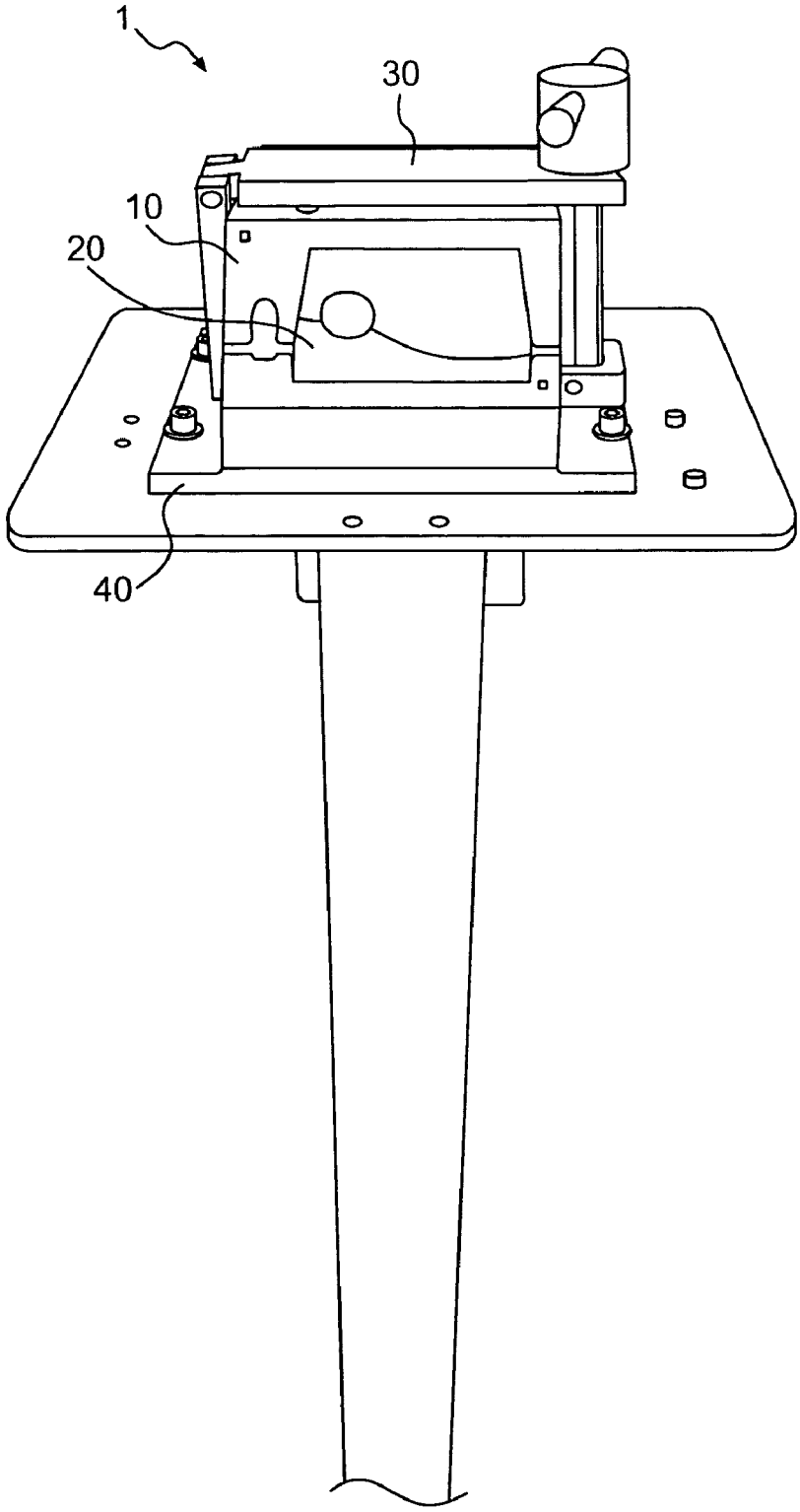
FIG. 2 shows a club fixture device of the present invention.
Figure 3:
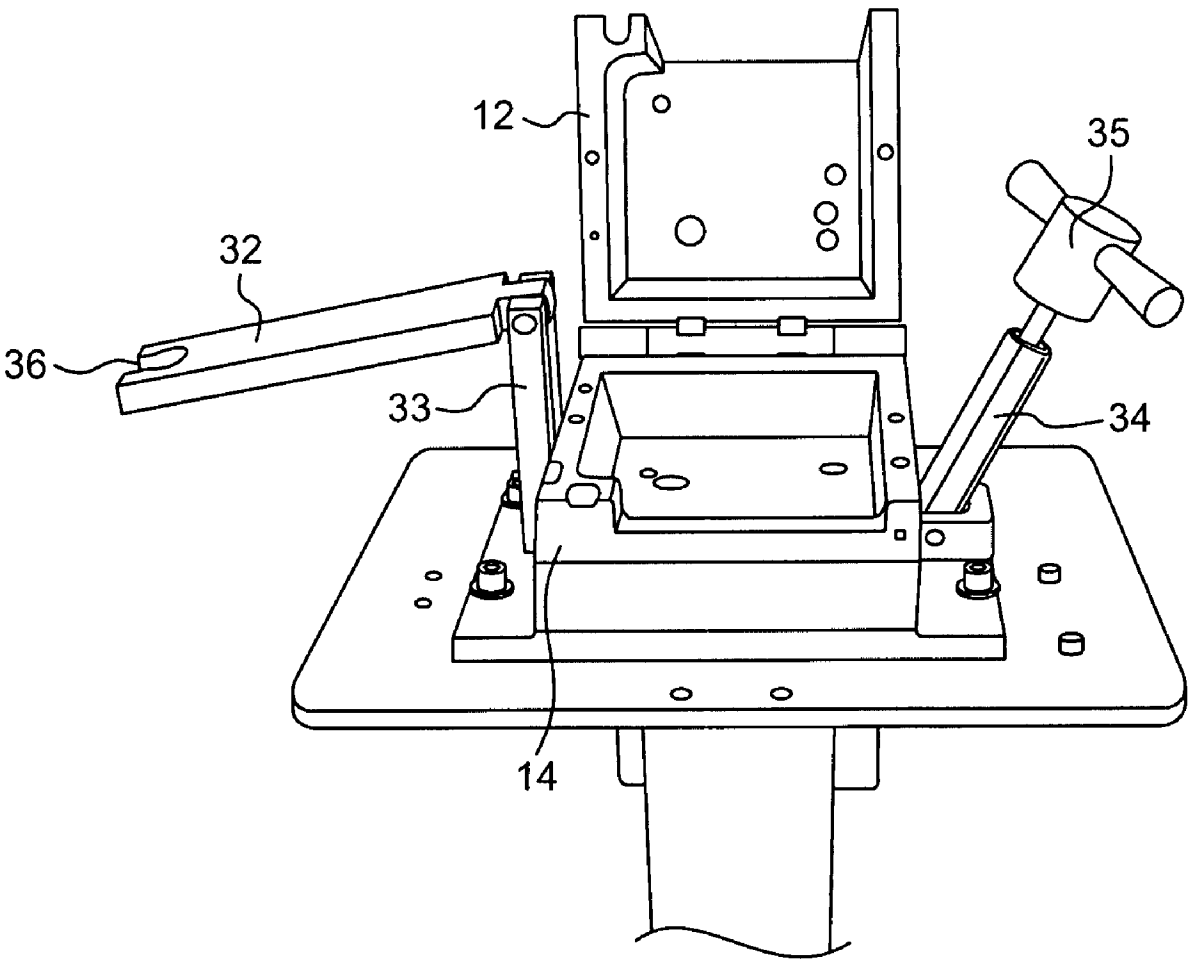
FIG. 3 shows the housing of the club fixture device of FIG. 2 in an open position.

FIG. 2 shows a club fixture device 1 of the present invention. Device 1 allows the user to customize a golf club by safely retaining the golf club head while allowing the hosel and shaft to be manipulated. Device 1 includes a housing 10, an insert 20, and a locking mechanism 30. Housing 10 preferably contains an upper housing part 12 and a lower housing part 14. The terms "upper" and "lower" are used herein for differentiation purposes only and should not be construed as limiting. As shown in FIG. 3, housing parts 12, 14 are preferably hingedly connected, allowing for relative rotation or separation of housing parts 12, 14 while retaining alignment thereof.

Insert 20 is removably coupled to housing 10. Insert 20 contains a cavity 26 configured to at least partially contact the golf club head therein. More preferably, cavity 26 is at least partially contoured to the golf club head. Still more preferably, cavity 26 substantially envelopes the golf club head.

Figure 4:
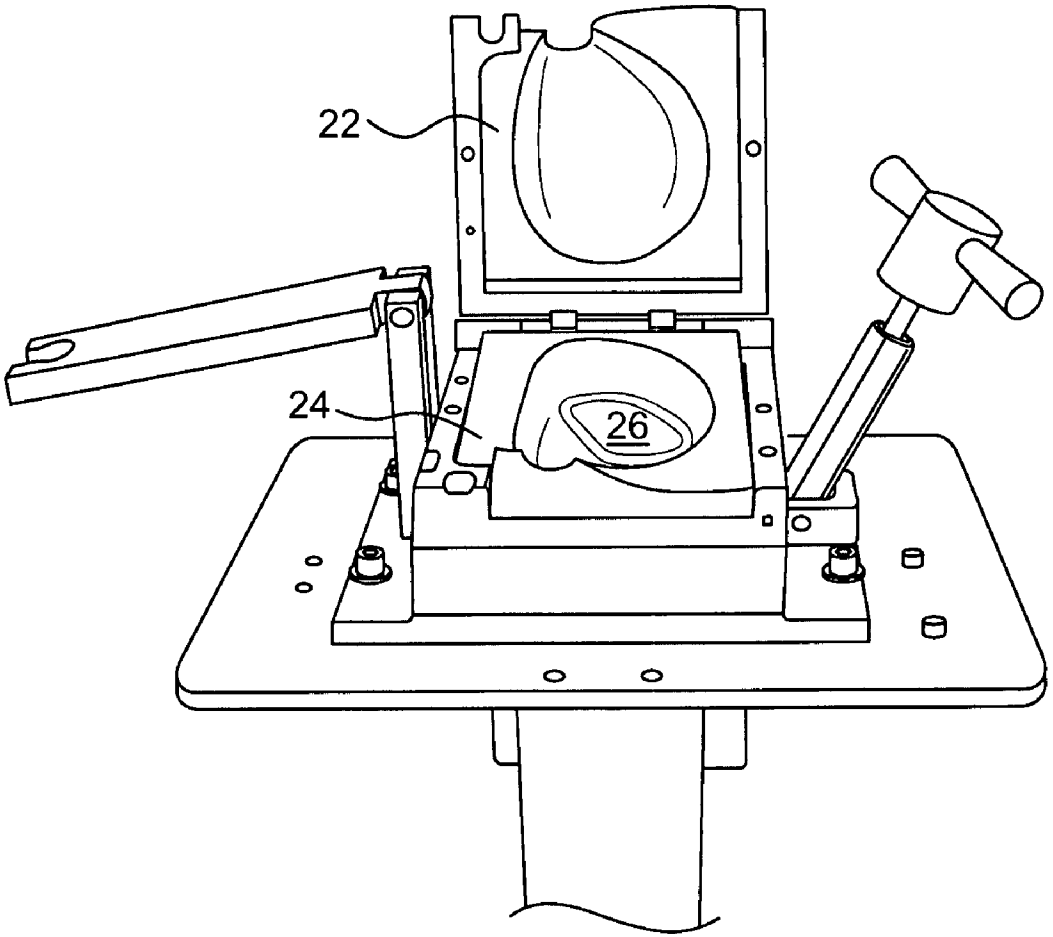
FIG. 4 shows the housing and insert of the club fixture device of FIG. 2 in an open position.
Figure 5:
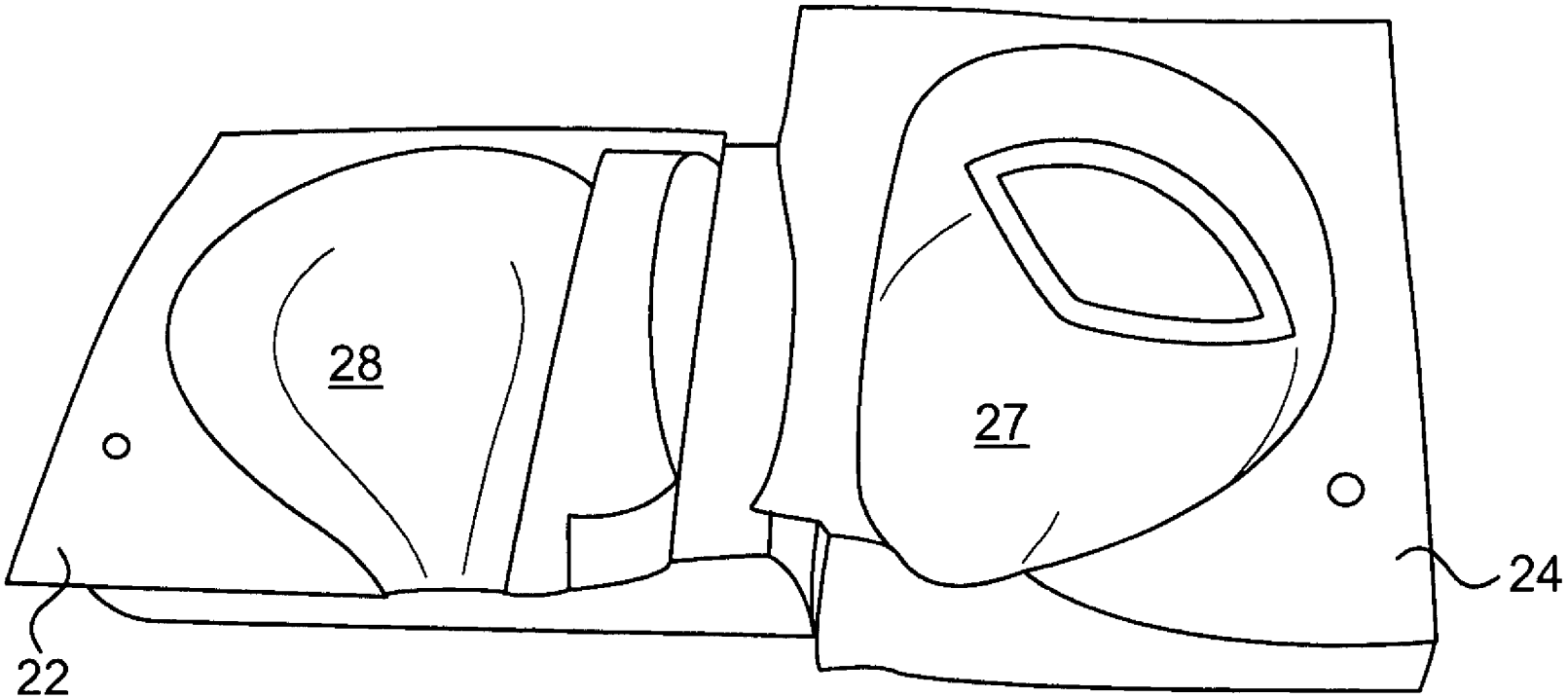
FIG. 5 shows the insert of the club fixture device of FIG. 2.

As shown most clearly in FIG. 5, insert 20 preferably contains an upper insert part 22 and a lower insert part 24. As shown in FIG. 4, upper insert part 22 is coupled to upper housing part 12 and lower insert part 24 is coupled to lower housing part 14. Insert parts 22, 24 are removably coupled to the respective housing parts 12, 14. Upper insert part 22 preferably contains an upper cavity part 28, and lower insert part 24 preferably contains a lower cavity part 27. Cavity parts 27, 28 are configured to matingly form cavity 26. Thus, distinct inserts 20 are readily interchangeable, allowing a specific insert 20 to be used depending upon the club that is to be altered. Since each of the inserts 20 is tailored to a specific golf club, device 1 may be used with each of a group of distinct golf clubs and easily achieve a tight grip on each of the distinct clubs. Note that different inserts 20 may be required for two club heads of the same make, but with varying loft angles. Additionally, inserts 20 for both right-handed and left-handed club heads should be provided. At least one of lower insert part 24 and upper insert part 22 defines a hole 29 configured to allow a shaft coupled to the golf club head to pass therethrough.

Insert 20 is preferably formed at least in part of a resin. Resin is relatively light, reducing the weight of device 1. This is desirable, especially when device 1 is portable. Synthetic resins, which have a polymeric structure, are preferred. Preferred synthetic resins include thermoplastic and thermosetting resins. Gel time is preferably one hour or less, and the cured resin preferably has a specific gravity of approximately 1.7 to approximately 1.8 and Shore D hardness of approximately 80 to approximately 90. The resin also preferably has an ultimate compressive strength, which is a measure of the resin's ability to withstand inward directed forces without failure, greater than 8,000 psi and from approximately 8,000 psi to approximately 15,000 psi. The ultimate flexural strength, which is a measure of the resin's ability to withstand bending forces without failure, preferably is greater than 5,000 psi and from approximately 5,000 psi to approximately 11,000 psi. The coefficient of thermal expansion, which is a measure of the resin's change in length per unit length for a one degree Fahrenheit change in temperature, preferably is within the range of approximately $1.5 \cdot 10^{-5}$ in./in/° F. to approximately $4.0 \cdot 10^{-5}$ in./in/° F. The post-cure specifications are measured at room temperature in customary fashion.

RP 132 resin is one preferred resin for inserts 20. RP 132 is a tough, fast-curing polyurethane that offers accurate reproduction of detail. It is an isocyanate, and has a cure time of approximately 5–7 minutes. Once cured, RP 132 has a specific gravity of 1.71 and a Shore D hardness of 84. It has an ultimate compressive strength of 8,200 psi, an ultimate flexural strength of 6,700 psi, and a coefficient of thermal expansion of $1.94 \cdot 10^{-5}$ in./in/° F.

Other preferred resins for inserts 20 include RP 3262 resin and RP 3269 resin, which are both epoxies. RP 3262 is an easy-to-mix system that provides excellent reproduction of detail. RP 3262 has a cure time of approximately 45 minutes. Once cured, RP 3262 has a specific gravity of 1.70 and a Shore D hardness of 86. It has an ultimate compressive strength of 14,400 psi, an ultimate flexural strength of 10,300 psi, and a coefficient of thermal expansion of $2.70 \cdot 10^{-5}$ in./in/° F.

RP 3269 is a low-shrinkage system with high strength and good machinability. RP 3269 has a cure time of approximately one hour. Once cured, RP 3269 has a specific gravity of 1.78 and a Shore D hardness of 87. It has an ultimate compressive strength of 14,400 psi, an ultimate flexural strength of 13,000 psi, and a coefficient of thermal expansion of $3.76 \cdot 10^{-5}$ in./in/° F.

Use of resin for inserts 20 is also desirable since it is relatively easy to work with. For example, inserts 20 may be formed by injection molding resin around a golf club head within a mold of the same dimension as the interior of housing 10. As is customary in the art, additives typically will be used with the resin during molding. After the resin has set, insert 20 may be cut and removed from the golf club, resulting in mating insert parts 22, 24 to be used with device 1. Casting is another preferred manufacturing technique to form inserts 20. Furthermore, use of resin allows for safely gripping the golf club to be customized without scratching or otherwise damaging the golf club.

Figure 6:
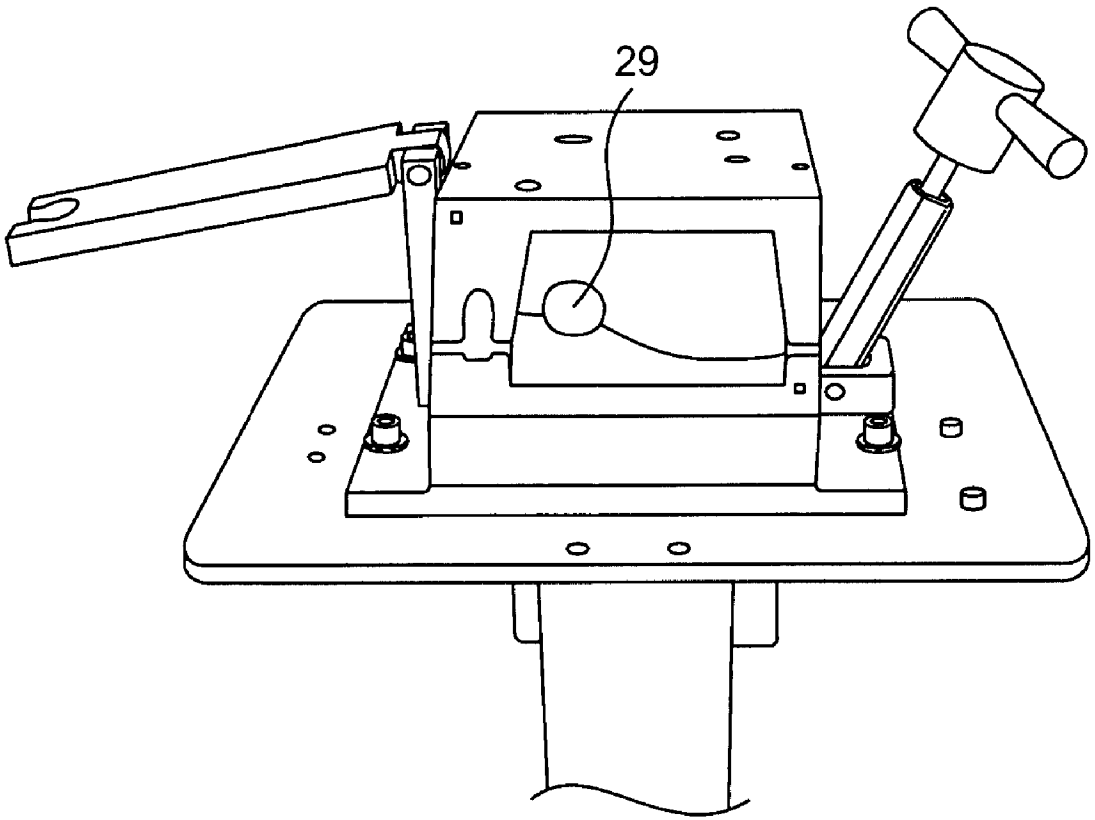
FIG. 6 shows the club fixture device of FIG. 2 in a closed but unlocked position.

Locking mechanism 30 is coupled to housing 10. Locking mechanism 30 preferably contains a cross bar 32, a locking bar 34, and, optionally, a stator bar 33. Stator bar is coupled to housing 10 at one end, and is hingedly coupled to cross bar 32 at an opposite end. Locking bar 34 preferably is hingedly coupled to housing 20, directly or through stator bar 33, and is selectively engageable with cross bar 32 to retain the golf club head within housing 20. Cross bar 32 is moveable between an open position, as shown in FIG. 6, in which housing parts 12, 14 are relatively moveable, and a closed position, as shown in FIG. 2, in which housing parts 12, 14 are relatively fixed.

Locking mechanism 30 further includes a lock 35. Lock 35 is selectively engageable to retain cross bar 32 in the closed position. In a preferred embodiment, cross bar 32 includes a notch 36, and locking bar 34 is configured to fit, at least in part, within notch 36. In the illustrated embodiment, locking bar 34 includes a portion having a reduced diameter that fits within notch 36. While locking bar 34 is within notch 36, lock 35 may be engaged to secure locking mechanism 30 in the closed position. Preferably, lock 35 is threadably engageable.

Figure 7:
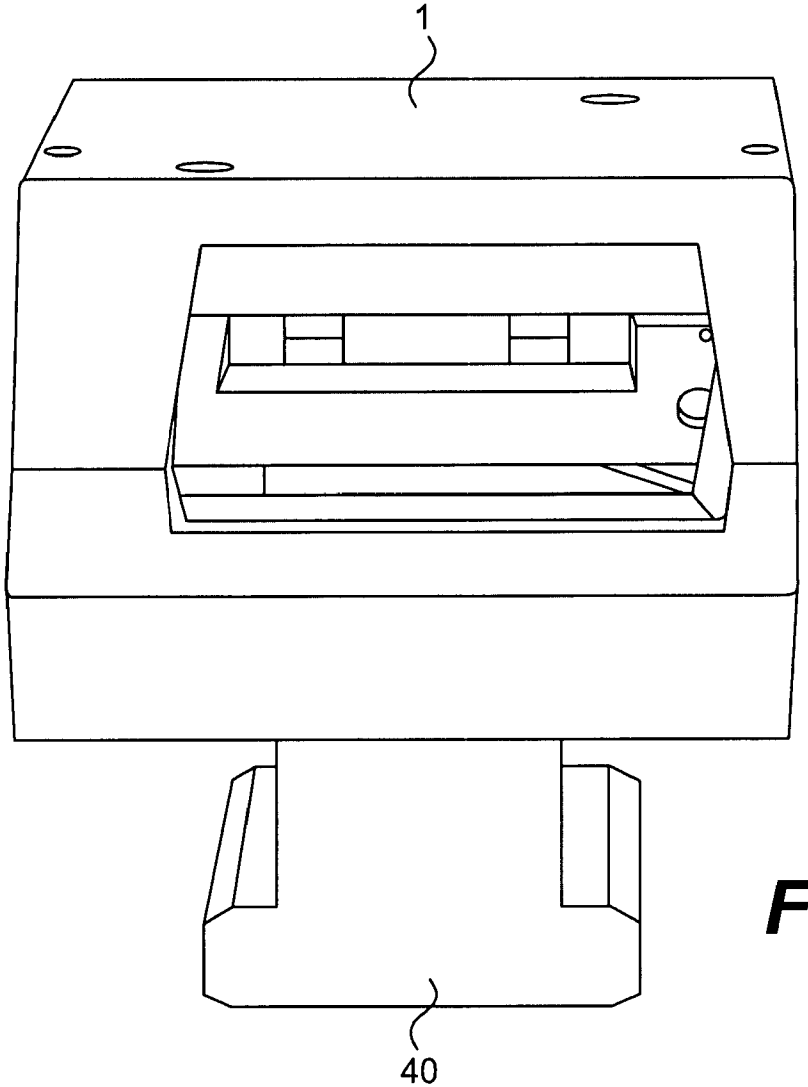
FIG. 7 shows the club fixture device of FIG. 2 with a second preferred base member.

Device 1 may also contain a base member 40, which allows device 1 to be coupled to another object. As seen in FIG. 2, base member 40 may be used to secure device 1 to a work station, facilitating use thereof. Base member 40 is preferably integral with housing 10. FIG. 7 shows another preferred embodiment of base member 40. In this embodiment, base member 40 is T-shaped such that device 1 may be easily secured with a vise, increasing the possible locations of use for device 1.

In use, device 1 is initially positioned as shown in FIG. 3. Locking mechanism 30 is placed in the open position, lock 35 is not engaged, housing part 12 is rotated away from housing part 14, and insert 20 is not coupled to housing 10.

Next, an insert 20 is chosen based upon the club to be manipulated. Insert parts 22, 24 are coupled to the respective housing parts 12, 14, as shown in FIG. 4, in known fashion. When coupled as described and shown, upper insert part 22 rotates toward or away from lower insert part 24 as upper housing part 12 rotates toward or away from lower housing part 14. When insert parts 22, 24 are rotated toward each other until they abut, cavity parts 27, 28 matingly form cavity 26.

Figure 8:
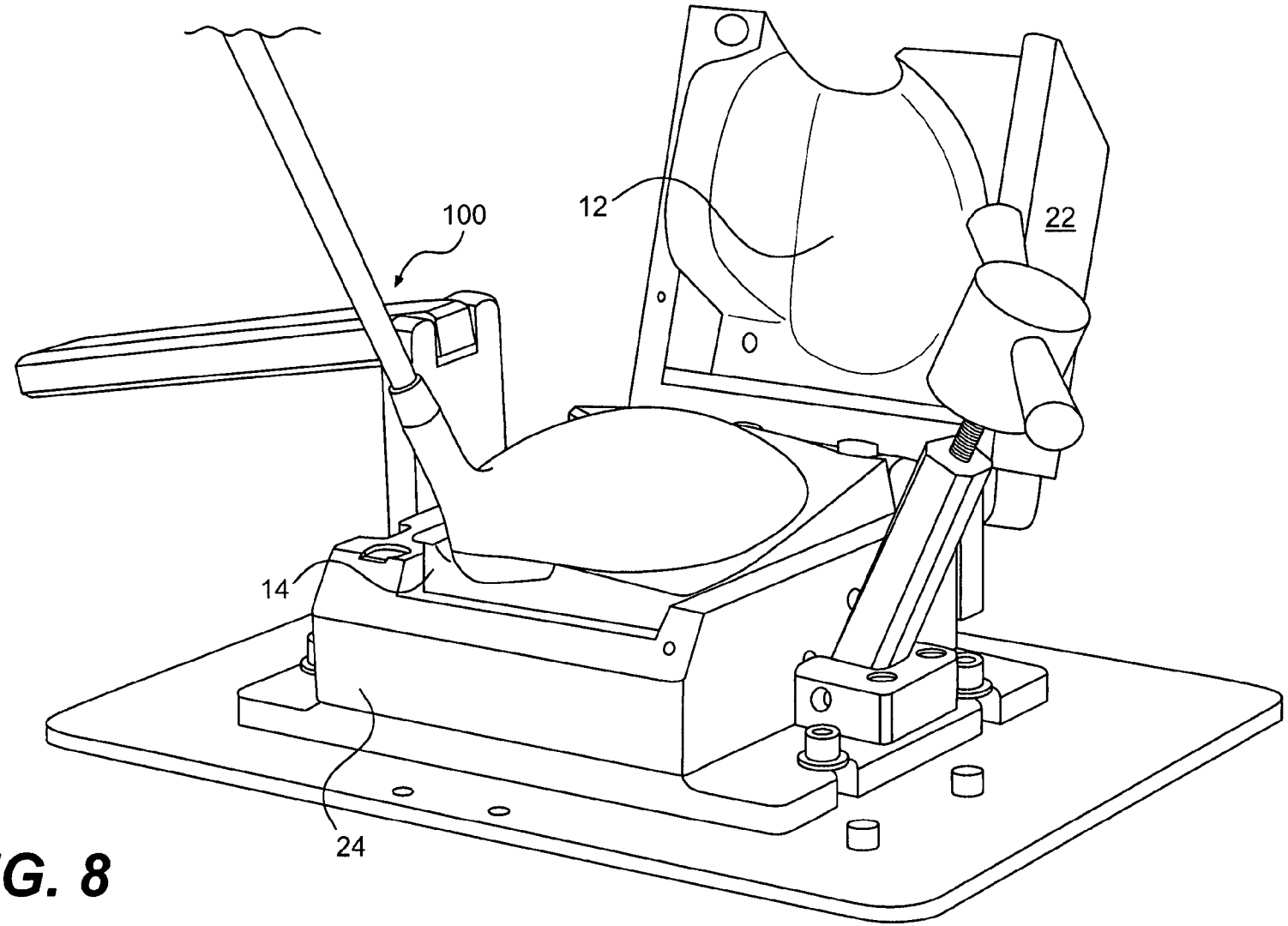
FIG. 8 shows the club fixture device of FIG. 2 in an open position with a golf club positioned in an insert part.

While device 1 is in the position illustrated in FIG. 4, a golf club head is placed within insert 20, as shown in FIG. 8. Housing parts 22, 24 are rotated toward each other to the position illustrated in FIG. 6, closing the club head (not shown) within cavity 26. Using the insert illustrated in the figures, the club head is substantially enveloped within cavity 26. This provides a snug fit, allowing the user to safely exert forces upon the club head as required to manipulate the golf club head as desired.

Figure 9:
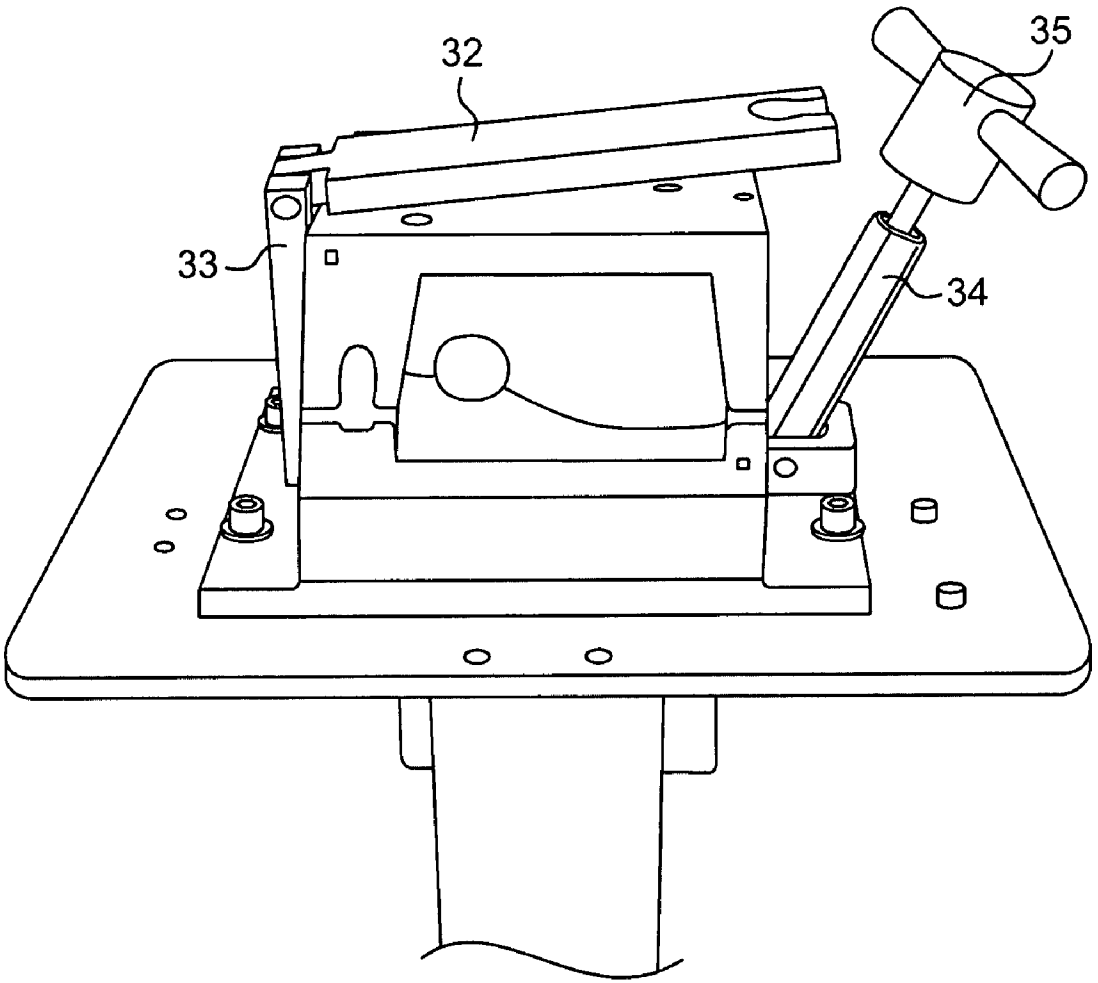
FIG. 9 shows the club fixture device of FIG. 2 in a closed but unlocked position.
Figure 10:
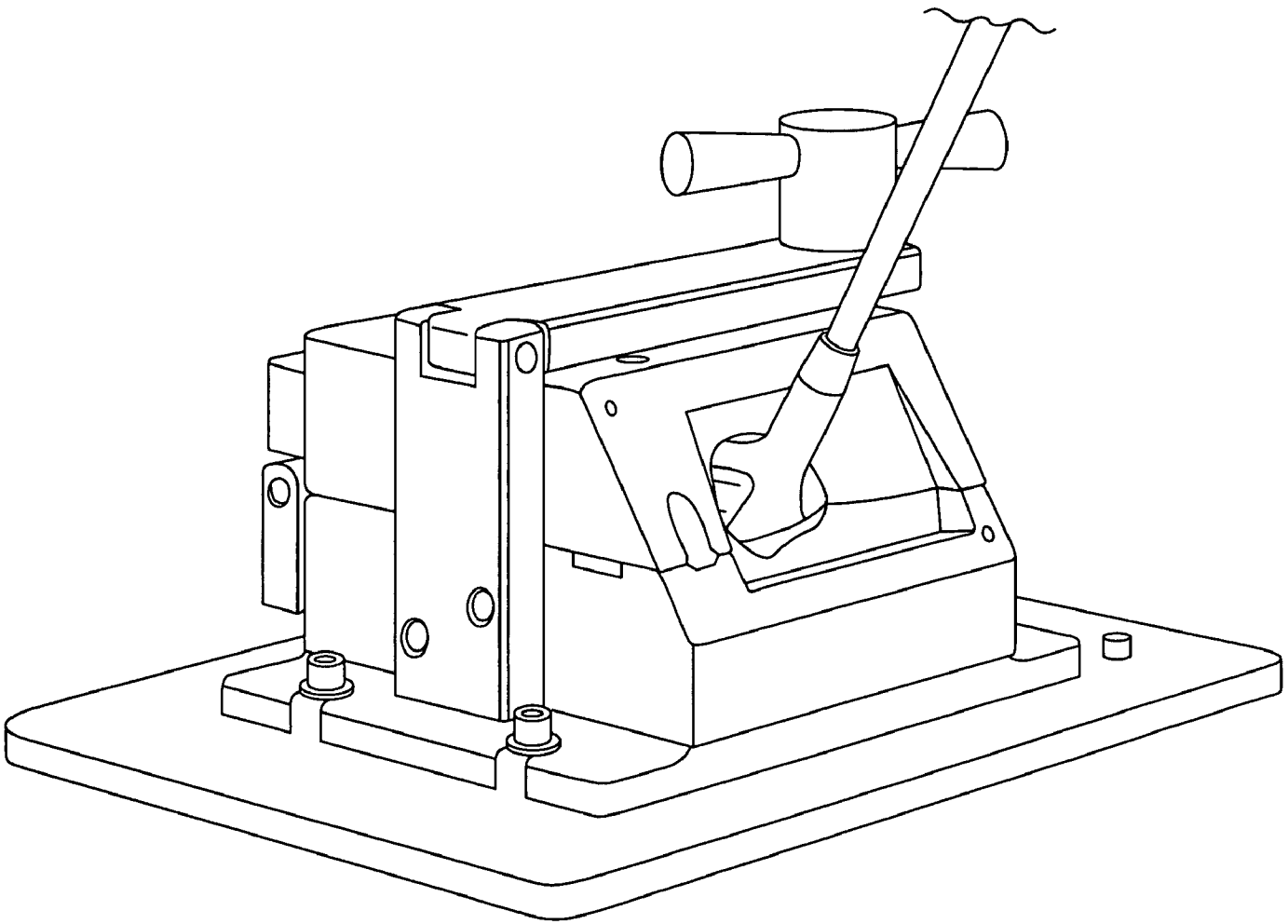
FIG. 10 shows the club fixture device of FIG. 2 retaining a golf club in a closed and locked position.

As shown in FIG. 9, lock bar 34 then is rotated away from housing 10 and cross bar 32 is rotated over housing 10. Next, lock bar 34 is rotated inward, so that, at least in part, locking bar 34 fits within notch 36 of cross bar 32. Lock 35 is then engaged, as shown in FIG. 10, locking device 1 in the closed position. Since device 1 is portable, base member 40 is preferably coupled to a work station. In this manner, the golf club is securely retained within device 1, and the user may safely customize the golf club.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A device for retaining a golf club head, comprising:

a housing including a lower housing part and an upper housing part;

an insert removably coupled to said housing, said insert containing a cavity configured to at least partially contact the golf club head therein, said insert including a lower insert part coupled to said lower housing part and an upper insert part coupled to said upper housing part, wherein at least one of said lower insert part and said upper insert part defines a hole configured to allow a shaft coupled to the golf club head to pass therethrough; and a locking mechanism coupled to said housing.

2. The device of claim 1, wherein said cavity is at least partially contoured to the golf club head.

3. The device of claim 2, wherein said cavity substantially envelopes the golf club head.

4. The device of claim 1, wherein said lower insert part is removably coupled to said lower housing part and said upper insert part is removably coupled to said upper housing part.

5. The device of claim 1, wherein:

said lower insert part contains a lower cavity part;

said upper insert part contains an upper cavity part; and said lower cavity part and said upper cavity part are configured to matingly form said cavity.

6. The device of claim 1, wherein said insert is formed at least in part of resin.

7. The device of claim 6, wherein said resin has a gel time of approximately one hour or less.

8. The device of claim 6, wherein said resin, when cured, has a specific gravity of approximately 1.7 to approximately 1.8.

9. The device of claim 6, wherein said resin, when cured, has a Shore D hardness of approximately 80 to approximately 90.

10. The device of claim 6, wherein said resin, when cured, has an ultimate compressive strength from approximately 8,000 psi to approximately 15,000 psi.

11. The device of claim 6, wherein said resin, when cured, has an ultimate flexural strength from approximately 5,000 psi to approximately 11,000 psi.

12. The device of claim 6, wherein said resin, when cured, has a coefficient of thermal expansion within the range of approximately 1.5·10–5 in./in/° F. to approximately 4.0·10–5 in./in/° F.

13. The device of claim 6, wherein said resin is selected from the group consisting of RP 132 resin, RP 3262 resin, and RP 3269 resin.

14. The device of claim 1, wherein said insert is removably coupled to said housing.

15. The device of claim 1, wherein:

said housing includes a lower housing part and an upper housing part; and said insert includes a lower insert part coupled to said lower housing part and an upper insert part coupled to said upper housing part.

16. The device of claim 15, wherein said lower housing part is hingedly connected to said upper housing part.

17. A device for retaining a golf club head, comprising:

a housing;

an insert removably coupled to said housing, said insert configured to at least partially contact the golf club head; and a locking mechanism coupled to said housing, wherein said locking mechanism includes a cross bar and a locking bar.

18. The device of claim 17, wherein said locking bar is selectively engageable with said cross bar to retain the golf club head within said housing.

19. The device of claim 17, wherein:

said locking mechanism further includes a stator bar coupled to said housing at one end and hingedly coupled to said cross bar at an opposite end; and said locking bar is hingedly coupled to said housing.

20. The device of claim 19, wherein:

said housing includes a lower housing part and an upper housing part, said lower housing part being hingedly connected to said upper housing part; and said cross bar is moveable between an open position, in which said housing parts are relatively moveable, and a closed position, in which said housing parts are relatively fixed.

21. The device of claim 20, wherein:

said locking bar includes a lock; and said lock is selectively engageable to retain said cross bar in said closed position.

22. The device of claim 19, wherein:

said cross bar includes a notch; and said locking bar is configured to fit, at least in part, within said notch.

23. The device of claim 22, further comprising a lock coupled to said locking bar.

24. The device of claim 23, wherein said lock is selectively engageable to retain or release said cross bar.

25. The device of claim 24, wherein said lock is threadably engageable.

26. The device of claim 1, wherein the device is portable.

27. The device of claim 1, further comprising a base member for securing said housing member.

28. The device of claim 27, wherein said base member is integral with said housing.

29. The device of claim 27, wherein said base member is configured to be at least partially retained within a vise.

30. A device for customizing each of a group of distinct golf clubs, comprising:

a housing;

a plurality of inserts, each of said inserts being tailored to a specific golf club of the group of distinct golf clubs; and a locking mechanism including a cross bar and a locking bar.

31. The device of claim 30, wherein each of said inserts is at least partially contoured to its specific golf club.

32. The device of claim 31, wherein each of said inserts substantially envelopes its specific golf club.

* * * * *